US009273572B2

(12) United States Patent
Neal et al.

(10) Patent No.: US 9,273,572 B2
(45) Date of Patent: Mar. 1, 2016

(54) OIL SYSTEM FOR DIESEL ENGINES THAT OPERATE IN COLD ENVIRONMENTS

(71) Applicants: Kennieth Neal, Mesa, AZ (US); Eugene Neal, Phoenix, AZ (US)

(72) Inventors: Kennieth Neal, Mesa, AZ (US); Eugene Neal, Phoenix, AZ (US)

( * ) Notice: Subject to any disclaimer, the term of this patent is extended or adjusted under 35 U.S.C. 154(b) by 0 days.

(21) Appl. No.: 14/329,798

(22) Filed: Jul. 11, 2014

(65) Prior Publication Data

US 2014/0317923 A1 Oct. 30, 2014

Related U.S. Application Data

(63) Continuation-in-part of application No. 13/417,760, filed on Mar. 12, 2012, now Pat. No. 8,833,333.

(60) Provisional application No. 61/942,761, filed on Feb. 21, 2014.

(51) Int. Cl.

| | |
|---|---|
| ***F01M 5/00*** | (2006.01) |
| ***F01P 7/16*** | (2006.01) |
| ***F01M 11/03*** | (2006.01) |
| ***B21J 1/00*** | (2006.01) |

(52) U.S. Cl.

CPC . *F01M 5/007* (2013.01); *B21J 1/00* (2013.01); *F01M 5/00* (2013.01); *F01M 11/03* (2013.01); *F01P 7/16* (2013.01); *Y10T 29/49233* (2015.01)

(58) Field of Classification Search

CPC ..... F01M 5/00; F01M 5/005; F01M 5/007; F01M 11/03; F01P 3/00; F01P 7/14; F01P 7/16; F01P 7/167; B21J 1/00; Y10T 29/49233

USPC ..... 123/41.33, 41.42, 196 R, 196 AB; 184/6.5, 104.3; 29/888.011

See application file for complete search history.

(56) References Cited

U.S. PATENT DOCUMENTS

| | | | | | |
|---|---|---|---|---|---|
| 2,419,630 | A * | 4/1947 | Cruzan | F01M 1/12 | 137/468 |
| 2,433,420 | A * | 12/1947 | Booth | F01M 5/007 | 123/196 AB |
| 2,613,034 | A * | 10/1952 | Weise | F01M 5/005 | 165/161 |
| 3,223,197 | A * | 12/1965 | Conover | F01M 1/02 | 184/104.3 |
| 4,027,643 | A * | 6/1977 | Feenan | F01M 5/007 | 123/196 AB |
| 4,324,213 | A * | 4/1982 | Kasting | B01D 35/12 | 123/196 A |
| 6,182,616 | B1 * | 2/2001 | Itoh | F01M 5/002 | 123/41.1 |
| 6,955,150 | B2 * | 10/2005 | Moss | F01M 1/12 | 123/196 AB |
| 7,082,903 | B2 * | 8/2006 | Hutchins | F01P 7/16 | 123/41.05 |
| 7,124,715 | B2 * | 10/2006 | Hutchins | B60H 1/00314 | 123/41.05 |

(Continued)

FOREIGN PATENT DOCUMENTS

GB 575425 A * 2/1946 ..... F01M 5/007

*Primary Examiner* — Lindsay Low
*Assistant Examiner* — Grant Moubry
(74) *Attorney, Agent, or Firm* — Hartman Titus PLC; John D. Titus

(57) ABSTRACT

An aftermarket modification for diesel engines that operate in cold environments particularly those using a liquid-to-air oil cooler. Engine oil can be routed to a bypass module having a thermostatic element that directs the oil to bypass the oil cooler and return to the engine if the engine oil is below the desired temperature. Once the desired oil temperature is reached, the thermostatic element moves toward a closed position to direct oil through the oil cooler. A pressure bypass element can be incorporated into the bypass module. If the pressure differential between the inlet and outlet of the cooler exceeds a set point, the bypass element moves toward an open position to direct a portion of the oil to bypass the oil cooler.

11 Claims, 4 Drawing Sheets

(56) References Cited

U.S. PATENT DOCUMENTS 8,141,790 B2 * 3/2012 Sheppard ..... F01P 7/16
236/100

8,375,917 B1 * 2/2013 Neal ..... F01M 5/002
123/196 A

2010/0212637 A1 * 8/2010 Lemke ..... F01B 7/14
123/51 R

* cited by examiner

OIL SYSTEM FOR DIESEL ENGINES THAT OPERATE IN COLD ENVIRONMENTS

CROSS-REFERENCE TO RELATED APPLICATION

This application is a continuation-in-part of co-pending U.S. patent application Ser. No. 13/417,760.

TECHNICAL FIELD

This invention relates generally to internal combustion engines and more specifically to oil coolers for internal combustion engines.

BACKGROUND

Compression ignition (diesel) engines experience various operational difficulties in cold temperatures. Difficult starting in cold weather can be attributed to various causes: Cold weather reduces the available battery current, decreasing the electrical power available to the engine self-starter. Injected fuel condenses on the cold cylinder surfaces leading to improper atomization, which inhibits formation of a combustible mixture inside the cylinder. The engine lubricating oil tends to thicken, leading to increased friction resisting the starter motor, further taxing a battery that may be operating at a reduced output. Hard starting problems can occur with mobile engines such as those in large trucks, buses and even smaller trucks such as the 6.0L and 6.4L POWER STROKE® diesel engines sold by Ford Motor Company. Engines for fixed installations often also encounter similar difficulties starting in cold weather.

Various systems and devices may be utilized to improve starting in cold weather, including battery heaters (to produce higher battery output), engine block heaters (to reduce oil viscosity and reduce fuel condensation), glow-plugs (installed in the cylinder to assist with combustion) and the like.

Proper lubrication can also be a problem in cold weather operation. The cold diesel fuel injected into the cold cylinders can condense and pass along the cylinder walls, diluting the lubricating oil. Engine lubrication in cold weather can also be a problem. The engine lubricating oil becomes more viscous in cold temperatures reducing its effectiveness in lubricating engine components during startup and initial operation. Consequently, some operators elect to use an very thin oil such as an exemplary 0W-20 to allow for easier cold weather starting. However, once the engine is warmed, the viscosity and therefore the oil film thickness in the bearings and elsewhere may drop below that recommended by manufacturers, allowing metal-to-metal contact at bearing surfaces leading to accelerated wear. Thus, another problem operators of diesel engines encounter during cold weather operation is selecting an oil that will adequately lubricate yet will not contribute unnecessarily to starting difficulties.

Since diesel engines operate in all seasons, hot weather operation is also a consideration. To aid hot weather operation, diesel engines are often equipped with engine oil coolers, which reduce oil temperature during hot driving conditions so as to keep the oil at a proper viscosity level. However, engine oil coolers do not aid engine operation in cold environments where it is often desirable to warm the oil rather than cooling it. If engines having an oil cooler could be fitted with a device to aid cold weather starting and operation then the useful temperature range of a diesel engine and its performance might be improved.

SUMMARY

The following presents a simplified summary of the disclosure in order to provide a basic understanding to the reader. This summary is not an extensive overview of the disclosure and it does not identify key/critical elements of the invention or delineate the scope of the invention. Its sole purpose is to present some concepts disclosed herein in a simplified form as a prelude to the more detailed description that is presented later.

Briefly, the present invention comprises a diesel engine oil system intended for cold weather operation. According to an illustrative embodiment, the system has a bypass module which includes both a pressure bypass element and a thermostatic bypass element which operate independently of one another. The system has several configurations. In one configuration, oil from the engine after passing through a filter can be directed to a tee fitting which has one branch coupled to an oil cooler and another branch coupled to the bypass module. If the oil temperature is below a preset temperature (about 180 F.), the thermostatic element will be open allowing high pressure oil to proportionately bypass the cooler, directing the oil to return to the engine.

In an alternative configuration, oil from the engine may also be introduced to the bypass module at another port if required by the installation environment. In this configuration. oil is either directed to the cooler or to the return oil engine circuit depending on the position of the thermostatic element in the bypass module.

In addition to a thermal bypass valve, the bypass module or block may include a pressure bypass element. This element opens at a predetermined pressure differential between the oil supply and the oil return oil to the engine. Should the return oil pressure drop or the supply pressure increase resulting in a pressure differential above a preset threshold level (indicative of a restricted or plugged oil cooler or oil cooler line), the pressure element will direct oil to flow to the return oil line to prevent oil starvation. When the pressure differential is below the threshold value (indicating that the engine oil demands are below that of the restriction) the pressure bypass element will close, directing oil to the oil cooler.

Many of the attendant features will be more readily appreciated as the same becomes better understood by reference to the following detailed description considered in connection with the accompanying drawings.

DESCRIPTION OF THE DRAWINGS

The present invention will be better understood from a reading of the following detailed description, taken in conjunction with the accompanying drawing figures in which like references designate like elements and, in which.

DETAILED DESCRIPTION

Figure 1:
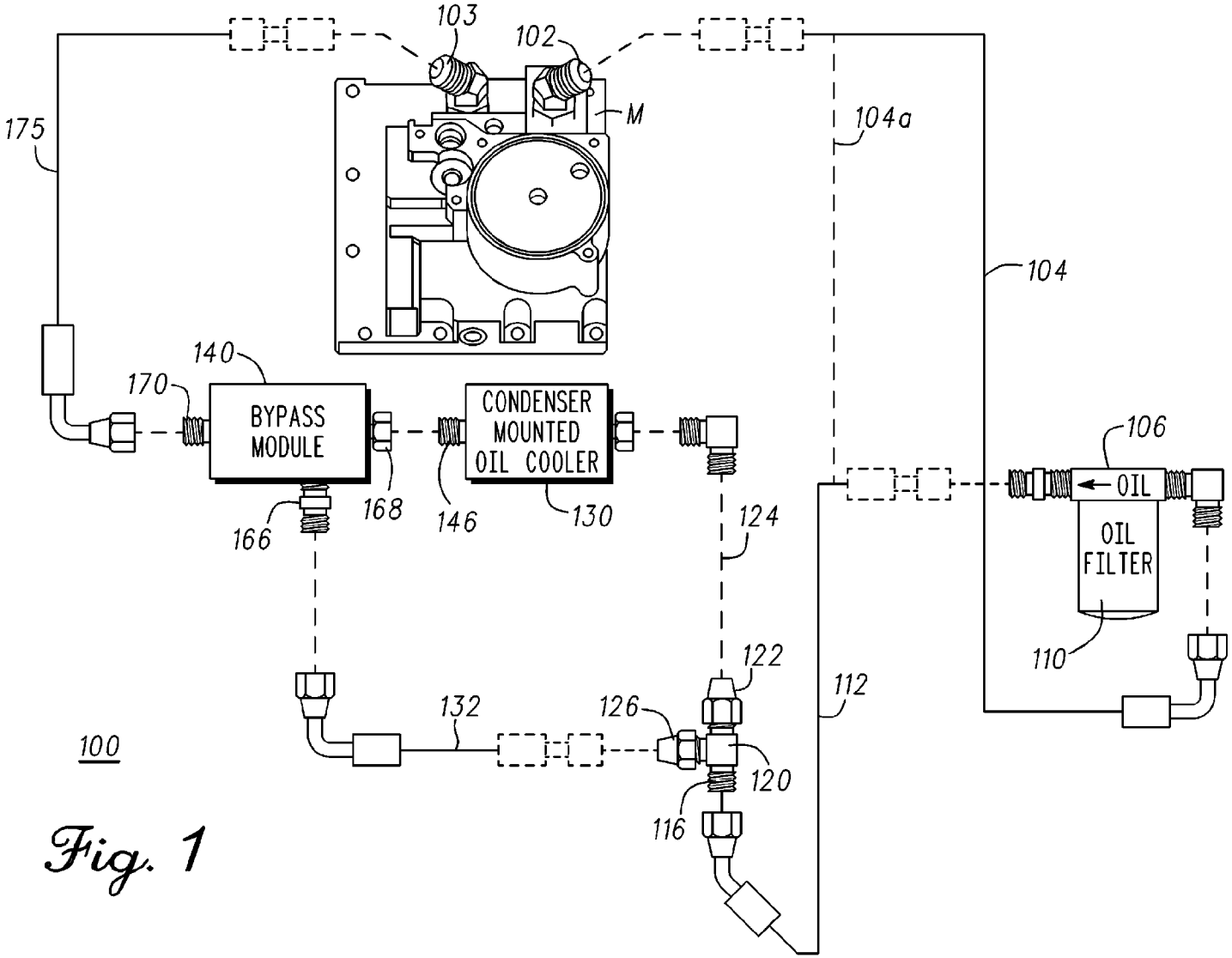
FIG. 1 is a schematic diagram of the cold weather lubrication system of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

FIG. 1 is a schematic diagram of an embodiment of a cold weather lubrication system incorporating features of the present invention as applied to an illustrative embodiment comprising a 6.0L or 6.4L Ford POWER STROKE diesel engine. The system of the present example is generally designated by the numeral 100 and may be a "stock" or Original Equipment Manufacturer (OEM) system but preferably comprises a retrofit aftermarket modification to an existing engine. The hose lengths provided and fittings shown are exemplary, and not meant to be limiting in any way. The engine is provided with an oil distribution manifold M, which in the illustrative embodiment is mounted to the top of the engine. The manifold M has an outlet 102 for oil which is pumped from the engine through the manifold by the engine low pressure oil pump (not shown).

In one embodiment, the oil is directed by line 104 to an oil filter mounting base 106 to which is attached an oil filter 110. Oil filter 110 is shown as spin-on style filter, which screws on to the conventionally constructed mounting base 106 and which has its own internal anti-backflow valve. Oil passes through the media within the oil filter and the filtered oil is discharged through line 112. The oil filter may be located in any convenient location in the engine compartment, or external to it. Alternatively, for example if the engine has an internal oil filter, or other filter that filters the oil before exiting manifold outlet port 102, the oil filter may be omitted so that the engine oil discharge connects directly to the tee fitting as shown in the dashed line 104*a* in FIG. 1. Additionally, although oil filter 110 is shown in the illustrative embodiment as spin-on style filter, cartridge, canister or other types of oil filters, with or without integral anti-backflow valves, may be utilized and therefore depiction of a spin-on filter is not intended to limit the invention in any way.

Line 112 connects to inlet 116 of tee fitting 120. Tee 120 has an outlet 122 coupled by line 124 to the inlet of oil cooler 130. Tee 120 has a second outlet 126 which is coupled by line 132 to the bypass block or module 140 at a first port 166. Oil cooler 130 has an outlet 146, which is connected to a second port 168 of bypass module. A third port 170 of bypass module is connected to port 103 of the manifold M by line 175.

The oil cooler 130 may be of a parallel plate construction optimized for liquid-to-liquid heat transfer, but preferably is of tube-and-fin construction optimized for liquid-to-air heat transfer. In a tube-and-fin configuration, hot oil passes through the tubes where it is cooled by the air passing over the tubes. Fins are attached to the tubes to increase the surface area and therefore the efficiency of the heat transfer between the oil and the air. The oil cooler 130 may be located in any suitable location where it can be subject to adequate airflow for cooling. A convenient location is to secure the cooler to the air conditioning condenser using suitable mounting brackets.

Figure 2:
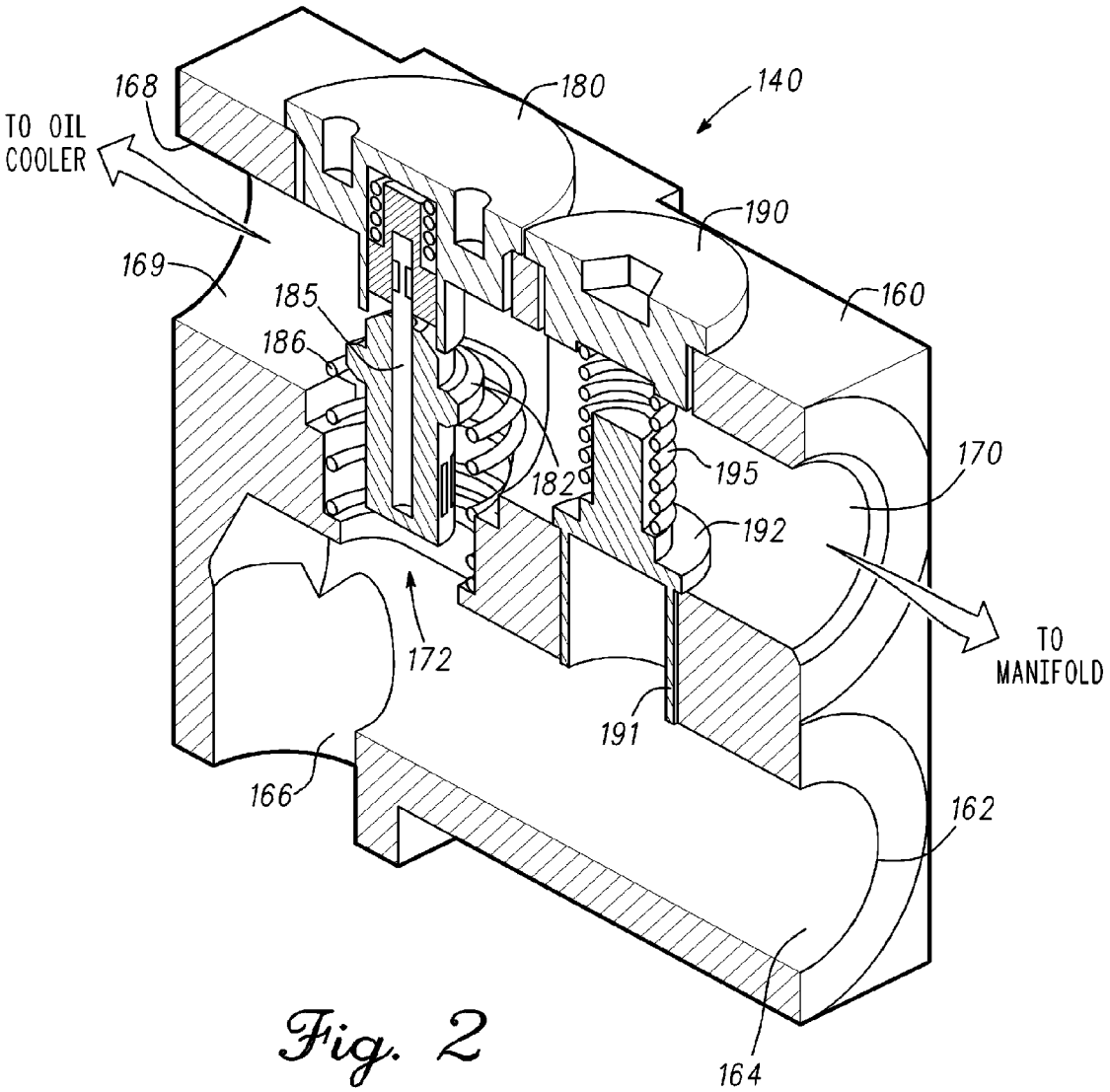
FIG. 2 is a cut-away perspective view of a bypass module showing the various ports and the temperatures and pressure bypass valve element.

FIG. 2 is a cut-away perspective view of the bypass module showing the various ports and the temperature and pressure bypass valve elements. The bypass module 140 has a body 160 of aluminum or other suitable material. Lower passage 164 extends within the body and may be intercepted at its blind end by threaded port 166. For simplicity, the threads are not shown. Alternatively, connections equivalent to threaded connections (e.g. quick disconnect, O-ring, hose clamp, etc.) may be provided.

Module 140 may include an auxiliary port 162 threaded to receive a fitting for connection for oil from the engine in one installation configuration as will be more fully explained hereinafter. If port 162 is present, but not used, it will be blocked by a threaded plug, or its equivalent.

An upper passage 169 extends in the upper portion of the bypass module, parallel to lower passage 164. Passage 169 has a port 170 which may be threaded (or equivalent) for connection to oil return line (175 of FIG. 1) for returning oil to the engine via the manifold (M of FIG. 1). Oil from the cooler (130 of FIG. 1) may be connected to the passage 169 at port 168. The upper passage 169 and lower passage 164 are coupled via a pressure bypass valve 190 and a temperature bypass valve 180. Temperature bypass valve 180 may be the type that is fully-open or fully-closed but is typically an analog valve that opens gradually from a closed position to its fully-open position. Conversely, the pressure bypass valve 190 may be an analog valve that opens gradually from a closed position to its fully-open position but is typically of the type that is fully-open or fully-closed.

A first transverse passage 172 extends between the upper and lower parallel passageways 164, 169. The passage 172 may be threaded to receive a thermostatic element 180. Thermostatic element operates to open a path from the upper passage 169 to lower passage 164 when a predetermined temperature is reached. The exemplary thermostatic valve element has a sealed chamber 182 that contains a material, such as a wax pellet, which will melt and expands as heated by the oil. Alternatively other thermostatic valve constructions may be provided. A rod 185 operates a valve member 186 in the passageway. Initially the thermostat is open, or is partially open, when the oil temperature in the module is below a preset threshold, as for example 180 degrees Fahrenheit, allowing some or all of the oil flow to bypass the cooler to return to the engine at port 170. The thermostatic element stays open until the oil temperature reaches the nominal thermostat opening temperature.

Thereafter. the thermostat element will dynamically adjust to progressively close in response to changes in oil temperatures, increasing flow to the cooler 130 as the oil temperature rises above the optimum preset temperature. If the temperature of the oil again decreases below the preset limit. the thermostatic element will open proportionately to allow oil to bypass the cooler, thus maintaining a minimum operational oil temperature.

Pressure bypass element 190 occupies the passage 191 between the lower passage 164 which receives oil from the engine (supply oil) and upper passage 168. If the return oil pressure in passage 170 drops or the supply pressure in passage 164 increases, the pressure element 190 will be subjected to an increased pressure differential, causing the valve flow control member 192 to open and direct high pressure oil to the return line via passage 191. This ensures the engine will continue to receive oil even if the oil cooler is occluded or the engine oil demand is above the flow-rate of the oil cooler. This assures a constant flow of oil to the engine in extreme operating conditions such as racing or in sub-freezing conditions. When the pressure differential across the pressure element is below the threshold valve required to open the pressure element, for example if the engine oil demand has decreased, the element is closed, blocking flow between passages 164 and 168.

The pressure bypass valve 190 has a flow control member 192 seated in the opening between the passages 164 and 168.

Spring 195 exerts a predetermined downward biasing force on the flow control member 192, maintaining the element closed until a predetermined pressure differential occurs which may be sufficient to overcome the spring bias. In alternative examples electronic sensing components may be used to sense pressure and temperature and operate electronically controlled valves.

Figure 3:
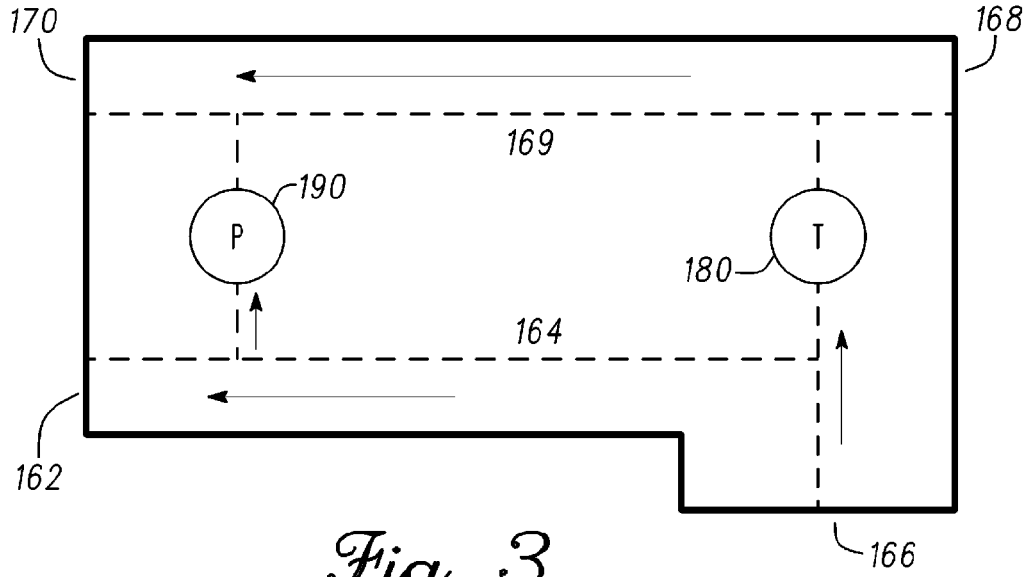
FIG. 3 illustrates the oil flow through the bypass module in one operational configuration of the present system.

FIG. 3 illustrates the oil flow through the bypass module according to a first embodiment. The thermostatic pressure elements 180 and 190, as described above, are also represented by the letters P and T. The cooler bypass port 166 may be coupled to branch 126 of tee 120. The cooler outlet may be coupled to port 168 at one end of passage 169. The opposite end of passage 169 has a port 170 for return oil to the engine.

In operation, oil from the engine, after filtration, enters the inlet 116 of tee 120, upstream of the cooler 130. If the temperature of the oil is below a preset level, thermostatic bypass element 180 will be open allowing oil to flow through passage 169, bypassing the oil cooler, and exiting port 170 to return to the engine. Once the oil reaches a predetermined temperature, typically about 180 F., then temperature element 180 will close, blocking the bypass channel and forcing the oil through the cooler, into the bypass module 140 at port 168, through passageway 169 to the return oil line 175.

Figure 4:
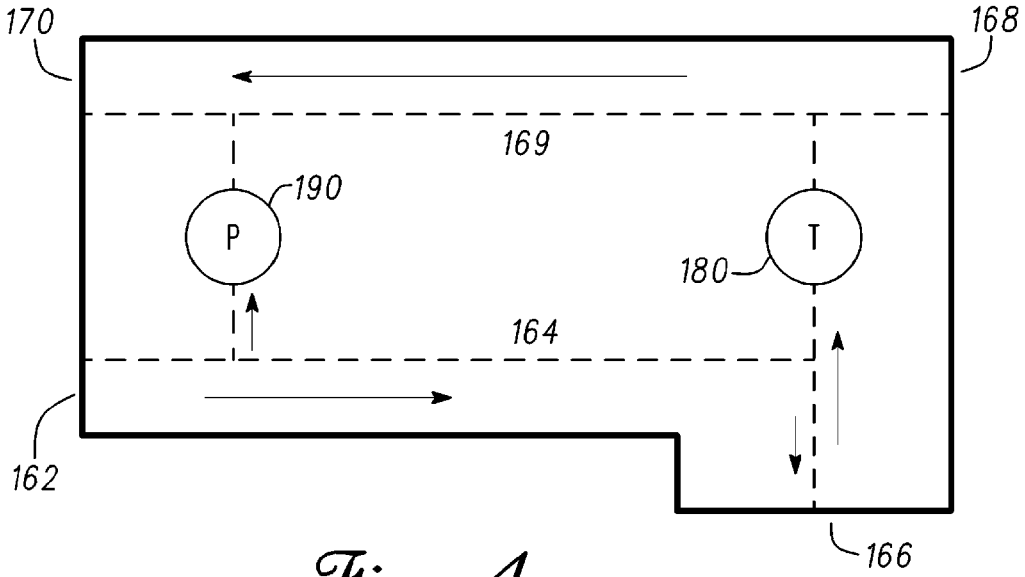
FIG. 4 illustrates the oil flow through the bypass module in another operational configuration.

FIG. 4 illustrates the oil flow through the bypass module in another embodiment. As in the embodiment of FIG. 3, the bypass elements 180, 190 are indicated by the letters P and T. Inlet port 162 is coupled to receive oil from the engine. If both bypass elements 180 and 190 are closed, oil flows out through the port 166 and may be directed through line 132 to the inlet of cooler 130. Cold oil returns via port 168 and travels through the module to the return engine oil circuit at port 170. The Tee fitting 120 is omitted since the tee channel is essentially incorporated into the bypass module.

The bypass elements 180 and 190 are independent working, as described, and will proportionately close to block bypass flow or open proportionately to allow a certain flow of oil to bypass the cooler.

The modification or retrofit for installing the system generally involves removing the Air Conditioning condenser and installing the oil cooler to the condenser. The bypass module 140 may be attached to the oil cooler or elsewhere on the vehicle using suitable brackets if necessary. The oil lines are coupled and the condenser reinstalled, removing any interfering structure.

Figure 5:
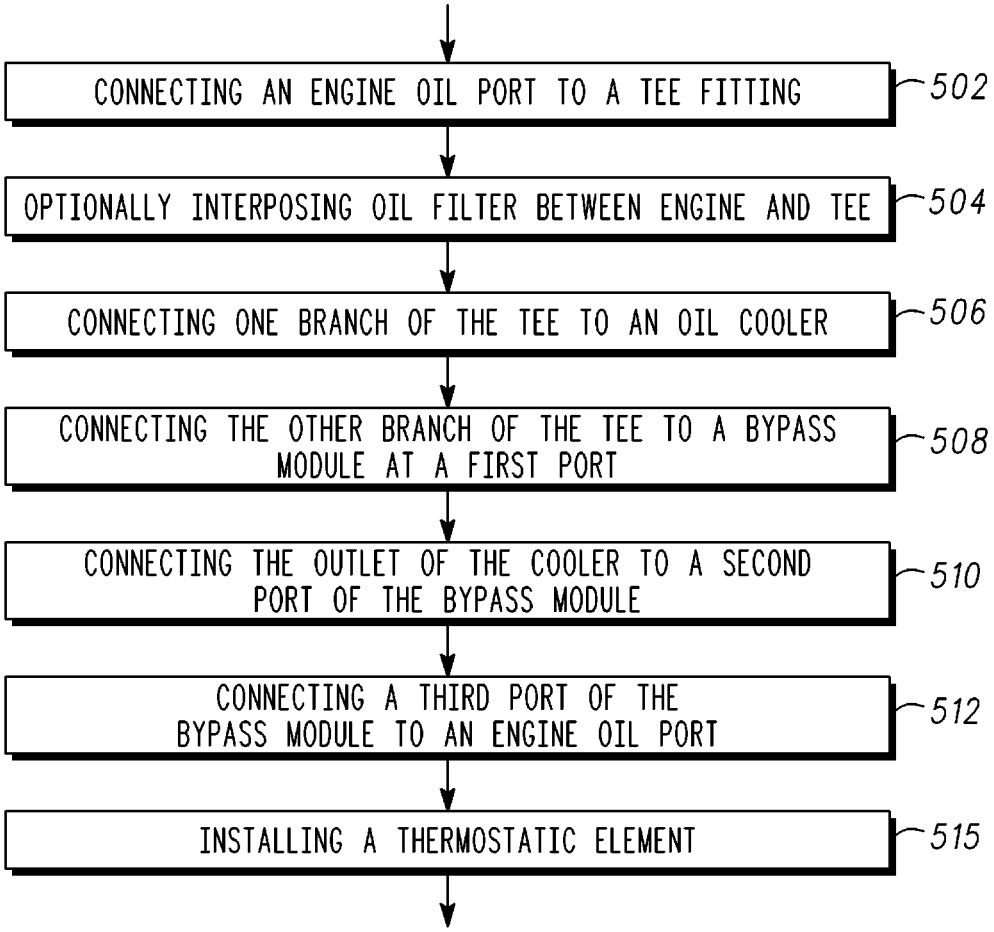
FIG. 5 shows a process for modifying a diesel engine for cold weather operation.

FIG. 5 shows a process for modifying a diesel engine for cold weather operation. At block 502 the tee fitting is connected to the engine oil outlet port. If an oil filter is present, then at block 504 the oil filter is interposed between the engine oil outlet port and the tee fitting. At block 506 connecting one branch of the tee to an oil cooler may be performed. At block 508 connecting the other branch of the tee to a bypass module at a first port may be performed. At block 510 connecting the outlet of the cooler to a second port of the bypass module, said second port communicating via a passageway with a return oil port may be performed. At block 512 connecting the return oil port to the engine return oil port may be performed. And at block 515 installing a thermostatic element which operates to direct oil to the return port of the oil temperature may be below a preset level and which, when closed, directs oil to the cooler before being directed to the return port may be performed. Note: As used herein "connected" does not mean attached directly, but means fluidically connected so that the oil flows from one element to another, and leaves open the possibility of intervening hoses, fitting or other elements, as opposed to the elements being physically connected directly to each other.

Although certain illustrative embodiments and methods have been disclosed herein, it will be apparent from the foregoing disclosure to those skilled in the art that variations and modifications of such embodiments and methods may be made without departing from the invention. For example, although in the illustrative embodiment of FIG. 1 the oil flow direction is from the engine to the tee fitting then to the oil cooler and bypass module, the position of the tee fitting and bypass module may be reversed (essentially reversing the flow in FIG. 1) so that the oil flows first to the bypass module then to the oil cooler and tee fitting. Similarly, although in the illustrative embodiment of FIG. 1 the oil flows to the oil filter then to the oil cooler, the oil filter may be omitted or may be installed downstream of the oil cooler (e.g. in hose 175). The oil filter may also be incorporated into the manifold where a manifold is required. Finally, although in the illustrative embodiment a manifold is attached to the engine to provide the oil outlet and return ports, the manifold may be omitted for example, where the engine is already equipped with oil outlet and return ports. Accordingly, it is intended that the invention should be limited only to the extent required by the appended claims and the rules and principles of applicable law. Additionally, as used herein, references to direction such as "up" or "down" are intend to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater, and as used herein, a step of "providing" a structural element recited in a method claim means and includes obtaining, fabricating, purchasing, acquiring or otherwise gaining access to the structural element for performing the steps of the method.

The invention claimed is:

1. A method of modifying a diesel engine for cold weather operation, said diesel engine having first and second engine oil ports comprising an engine oil outlet port and an engine oil return oil port, said method comprising:

providing a tee fitting;

connecting the first engine oil port to the tee fitting;

providing an oil cooler having first and second fluid ports for transmitting a flow of oil;

providing a bypass module having first, second and third fluid ports;

connecting a first branch of the tee fitting to the first fluid port of the oil cooler;

connecting a second branch of the tee fitting to the first fluid port of the bypass module;

connecting the second fluid port of the oil cooler to the second fluid port of the bypass module, the second fluid port of the bypass module communicating via an internal passageway with the third fluid port of the bypass module;

connecting the third fluid port of the bypass module to the second engine oil port; and wherein the bypass module comprises a thermostatic element that moves toward a first position to allow a flow of oil between the first fluid port of the bypass module and the third fluid port of the bypass module if an oil temperature is below a preset level and moves toward a second position to allow a flow of oil between the second fluid port of the bypass module and the third fluid port of the bypass module, whereby a flow of oil is directed to the oil cooler if the oil temperature is above a predetermined level.

2. The method of claim 1, wherein:

the bypass module further comprises a pressure relief element that moves toward a first position to allow a flow of oil between the first fluid port of the bypass module and the third fluid port of the bypass module if a pressure differential between the first engine oil port and the second engine oil port is above a predetermined level and moves toward a second position to allow a flow of oil between the second fluid port of the bypass module and the third fluid port of the bypass module if the pressure differential between the first engine oil port and the second engine oil port is below the predetermined level.

3. The method of claim 1, further comprising:

attaching a non-original equipment manifold to the engine oil outlet and engine oil return oil ports for providing external connections to the engine oil outlet and engine oil return oil ports.

4. The method of claim 1, wherein:

the oil cooler is a liquid-to-air heat exchanger.

5. The method of claim 1, further comprising:

connecting an oil filter to the engine oil outlet port; and connecting the oil filter to the bypass module.

6. A method of modifying a diesel engine for cold weather operation, said diesel engine having engine oil outlet and return oil ports, said method comprising:

connecting the engine oil outlet port to a bypass module at a first port of the bypass module;

connecting an oil cooler to the bypass module at a second port of the bypass module, said second port of the bypass module communicating via an internal passageway with a discharge port of the bypass module; and connecting the discharge port of the bypass module to the engine return oil port;

wherein the bypass module comprises a thermostatic element that moves toward a first position to direct oil from the first port of the bypass module to the discharge port of the bypass module if an oil temperature is below a preset level and moves toward a second position to direct oil to the oil cooler if the oil temperature is above the preset level; and wherein the bypass module comprises a further comprises a pressure relief element that moves toward a first position to direct oil from the first port of the bypass module to the discharge port of the bypass module if a pressure differential between the engine oil outlet port and the engine oil return port is above a predetermined level and moves toward a second position to direct oil to the oil cooler if the pressure differential between the engine oil outlet port and the engine oil return port is below the predetermined level.

7. The method of claim 6, further comprising:

connecting a tee fitting between the engine oil outlet port and the bypass module, the tee fitting having a first and a second branch, the first branch being attached to the bypass module and the second branch being attached to the oil cooler.

8. The method of claim 6, wherein:

the bypass module includes a branched passage, the branched passage having a first branch communicating with the outlet port of the bypass module via the thermostatic element, the branched passage further comprising a second branch in fluid communication with the oil cooler.

9. The method of claim 6, further comprising: attaching a manifold to the engine oil outlet and return oil ports for providing external connections to the engine oil outlet and return oil ports.

10. The method of claim 6, wherein:

the oil cooler is a liquid-to-air heat exchanger.

11. The method of claim 6, further comprising:

connecting an oil filter to the engine oil outlet port; and connecting the oil filter to the bypass module.

* * * * *